US007225576B2

(12) United States Patent
Ballard

(10) Patent No.: US 7,225,576 B2
(45) Date of Patent: Jun. 5, 2007

(54) MIRROR SIGHT APPARATUS FOR GUNS

(76) Inventor: Marlin Daniel Ballard, 4900 W. William Cannon, Austin, TX (US) 78749

( * ) Notice: Subject to any disclaimer, the term of this patent is extended or adjusted under 35 U.S.C. 154(b) by 0 days.

(21) Appl. No.: 10/954,776

(22) Filed: Sep. 30, 2004

(65) Prior Publication Data

US 2006/0010756 A1 Jan. 19, 2006

Related U.S. Application Data

(63) Continuation-in-part of application No. 10/877,013, filed on Jun. 26, 2004, now Pat. No. 7,140,142.

(51) Int. Cl.
*F41G 1/30* (2006.01)

(52) U.S. Cl. ..... 42/118; 42/90; 42/111; 42/148; 356/255

(58) Field of Classification Search ..... 42/111, 42/118, 126

See application file for complete search history.

(56) References Cited

U.S. PATENT DOCUMENTS

| | | | | |
|---|---|---|---|---|
| 40,256 | A * | 10/1863 | Garretson | 42/111 |
| 187,432 | A * | 2/1877 | Totten | 356/153 |
| 694,904 | A | 3/1902 | Youlten | |
| 708,720 | A | 9/1902 | Konig | |
| 880,378 | A | 2/1908 | Geis | |
| 1,227,544 | A * | 5/1917 | Lobdell | 356/255 |
| 1,260,285 | A | 3/1918 | Cordell | |
| 1,264,133 | A * | 4/1918 | Morris | 42/118 |
| 3,262,440 | A * | 7/1966 | Kuhn | 124/67 |
| 3,863,354 | A * | 2/1975 | Karppinen | 42/118 |
| 4,878,305 | A | 11/1989 | Gabrielidis | |
| 6,311,424 | B1 | 11/2001 | Burke | |
| 6,643,969 | B1 | 11/2003 | Avizonis | |
| 6,715,227 | B2 | 4/2004 | Swain | |

* cited by examiner

*Primary Examiner*—Troy Chambers
*Assistant Examiner*—Stewart Knox
(74) *Attorney, Agent, or Firm*—David O. Simmons

(57) ABSTRACT

A single-mirror target viewing apparatus configured for enabling a gun to be fired at a desired target from a cover position in an aimed manner. The target viewing apparatus comprises a mirror assembly, a mounting base and a sighting device. The mirror assembly includes a single utilized mirror that provides a target imaging surface. The mounting base is configured for being attached to a gun and having the mirror assembly moveably attached thereto. The single utilized mirror is movable between a stowed position and a deployed position and is rotatable between a plurality of rotational positions when in the deployed position. The sighting device is attached to a non-viewing portion of the mirror assembly.

15 Claims, 5 Drawing Sheets

MIRROR SIGHT APPARATUS FOR GUNS

RELATED APPLICATIONS

This application is a continuation-in-part of application Ser. No. 10/877,013, filed on Jun. 26, 2004, now U.S. Pat. No. 7,140,142 entitled "Mirror Sight Apparatus For Guns" and having a common applicant herewith.

FIELD OF THE DISCLOSURE

The inventive disclosures made herein relate generally to sighting apparatuses and systems for guns and, more particularly, to apparatuses and systems configured for enabling a gun to be fired from cover positions in an aimed manner.

BACKGROUND

Apparatuses that are configured for use on a gun (e.g. a rifle, a handgun, paintball gun, etc.) for permitting a shooter of the gun to fire it from a cover position in an aimed manner are known (i.e., conventional cover-position sighting apparatuses). Examples of such apparatuses are disclosed in U.S. Pat. Nos. 6,643,969; 6,311,424; 3,863,354; 1,260,285; 880,378 and 694,904. In permitting a shooter of the gun to fire it from a cover position in an aimed manner, the shooter of the gun is able to remain substantially out of a line of enemy fire while being able to fire at hostile targets in an aimed manner. Firing in this manner in a hostile or potentially hostile engagement saves lives and saves ammunition, both of which are important endeavours in a hostile or potentially hostile engagement.

Such conventional cover-position sighting apparatuses are known to have limitations that adversely affect their effectiveness, desirability and/or practicality. One limitation of certain conventional cover-position sighting apparatuses is that they are inefficient in enabling a desired target to be accurately and timely acquired, even with excessive training. This is unacceptable as it puts shooters at risk and such training can often be in conflict with preferred engagement tactics. Some of such conventional apparatuses have the limitation of making a gun cumbersome due to being non-stowable, being non-removable, being difficult to remove and/or their physical size. This adversely impacts their mobility and convenience, makes them susceptible to damage and/or puts them in the way of other components of the gun. Another limitation of some conventional apparatuses is that they generate images that are distorted and/or disorienting, making it difficult to aim in an accurate and/or repeatable manner. Still another limitation of some conventional apparatuses is that they include multiple mirrors that require an undesirably high degree of alignment for enabling effective aiming. Some conventional apparatuses require a shooter to have close facial proximity to the gun in order to acquire a desired target, which is often a limitation in that this can adversely affect safety of the shooter. Yet another limitation of some conventional apparatuses is that they are overly expensive to implement, maintain and/or replace.

Therefore, apparatuses and systems configured for enabling a gun to be fired from cover positions in an aimed manner and that they at least partially overcome limitations associated with such conventional approaches for enabling firing from cover positions would be useful and novel.

SUMMARY OF THE DISCLOSURE

In one embodiment, a single-mirror target viewing apparatus configured for enabling a gun to be fired at a desired target from a cover position in an aimed manner. The target viewing apparatus comprises a mirror assembly, mounting base and a sighting device. The mirror assembly includes a single utilized mirror that provides a target imaging surface. The mounting base is configured for being attached to a gun and having the mirror assembly moveably attached thereto. The single utilized mirror is movable between a stowed position and a deployed position and is rotatable between a plurality of rotational positions when in the deployed position. The sighting device is attached to a non-viewing portion of the mirror assembly.

In another embodiment, a gun sight system comprises a target acquisition apparatus, a single-mirror target viewing apparatus and a sighting device. The target acquisition apparatus is mountable on a gun and includes means for visually indicating when the gun is aimed at a desired target (i.e., the means for visually indicating). The single-mirror target viewing apparatus is mountable on the gun and including a single utilized mirror that provides a target imaging surface. The single-mirror target viewing apparatus is configured for enabling a shooter to view on the target imaging surface both the desired target and the means for visually indicating thereby enabling the gun to be fired at the desired target from a cover position in an aimed manner. The sighting device is attached to a non-viewing portion of the mirror assembly.

In another embodiment, a gun configured for being fired at a desired target from a cover position in an aimed manner comprises a gun including a gun body, a target acquisition apparatus, a single-mirror target viewing apparatus and a sighting device. The gun includes a gun body. The target acquisition apparatus is mounted on the gun body and includes means for visually indicating when the gun is aimed at a desired target. The single-mirror target viewing apparatus is mounted on the gun body and includes a single utilized mirror that provides a target imaging surface. The single-mirror target viewing apparatus is configured for enabling a shooter to view on the target imaging surface both the desired target and the means for visually indicating thereby enabling the gun to be fired at the desired target from a cover position in an aimed manner. The sighting device is attached to a non-viewing portion of the mirror assembly.

Accordingly, it is a principal object of the inventive disclosures made herein to provide apparatuses and systems configured for enabling a gun to be fired from cover positions in an aimed manner and that at least partially overcomes limitations associated with conventional approaches for enabling firing from cover positions. Specifically, apparatuses and systems in accordance with embodiments of the disclosures made herein are simple and timely in their ability to accurately acquire a desired target, without requiring excessive training to become proficient in their use and/or training that is in conflict with preferred engagement tactics. Such apparatuses and systems are relatively small and non-obtrusive, which enhances their mobility, durability and convenience, particularly when configured for being stowable. They provide clear and intuitive imaging of targets (e.g., no mirror-induced disorientation) and means for visually indicating when the gun is aimed at a desired target. They are mountable in a manner that is simple and that readily permit their removal. Their single utilized mirror configuration does not require precision alignment as is required by multiple mirror apparatuses. Their single utilized mirror can be made large enough to eliminate the need for close facial proximity to the weapon while still achieving accurate aiming and providing safety for the shooter. Finally, they are relatively inexpensive to implement, maintain and/or replace.

Turning now to specific embodiments of the inventive disclosures made herein, in at least one embodiment of the inventive disclosures made herein, the mirror assembly is pivotally mounted on the mounting base for enabling the mirror assembly to be folded between the stowed position and the deployed position.

In at least one embodiment of the inventive disclosures made herein, the sighting device is attached to a non-viewing portion of the single utilized mirror.

In at least one embodiment of the inventive disclosures made herein, the sighting device moves in concert with the mirror assembly.

In at least one embodiment of the inventive disclosures made herein, the mirror assembly is in a non-use position when the sighting device is in a use position.

In at least one embodiment of the inventive disclosures made herein, the single utilized mirror is rotatable between a plurality of rotational positions when in a deployed position.

In at least one embodiment of the inventive disclosures made herein, the mirror assembly and the mounting base are jointly configured for selectively securing the mirror assembly in at least one of the rotational positions.

In at least one embodiment of the inventive disclosures made herein, an axis of rotation of the single utilized mirror extends through a central region of the single utilized mirror when the single utilized mirror is in the deployed position.

In at least one embodiment of the inventive disclosures made herein, the mirror assembly and the mounting base are jointly configured for selectively securing the single utilized mirror in at least one of the rotational positions.

In at least one embodiment of the inventive disclosures made herein, the target acquisition apparatus includes at least one of an optical sight apparatus, an opto-electical sight apparatus, and a set of accessory physical sights.

In at least one embodiment of the inventive disclosures made herein, the target acquisition apparatus and the single-mirror target viewing apparatus are mounted on a mounting member configured for being mounted on the gun.

In at least one embodiment of the inventive disclosures made herein, the mounting member is configured for being attached to a precision-formed accessory mounting portion of the gun and includes a precision-formed apparatus mounting portion for enabling the target acquisition apparatus and the single-mirror target viewing apparatus to be mounted thereto.

In at least one embodiment of the inventive disclosures made herein, the target acquisition apparatus and the single-mirror target viewing apparatus are both mounted either above the barrel portion of the gun, to a side of the barrel portion of the gun and below the barrel portion of the gun.

These and other objects and embodiments of the inventive disclosures made herein will become readily apparent upon further review of the following specification and associated drawings.

DETAILED DESCRIPTION OF THE DRAWINGS

Figure 1:
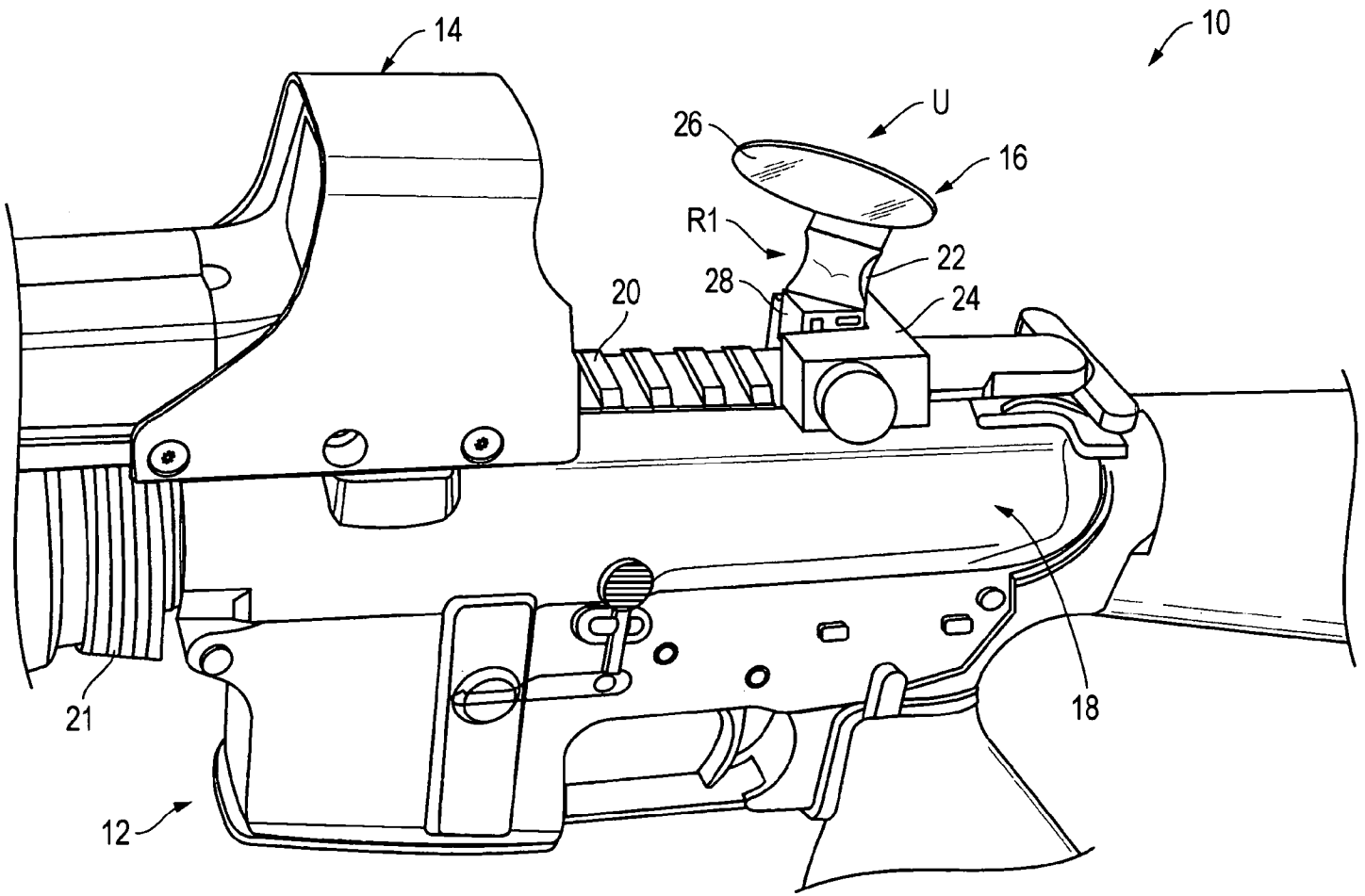
FIG. 1 depicts a gun adapted in accordance with a first embodiment of the inventive disclosures made herein, wherein a single-mirror target viewing apparatus of the gun is in a use position.
Figure 2:
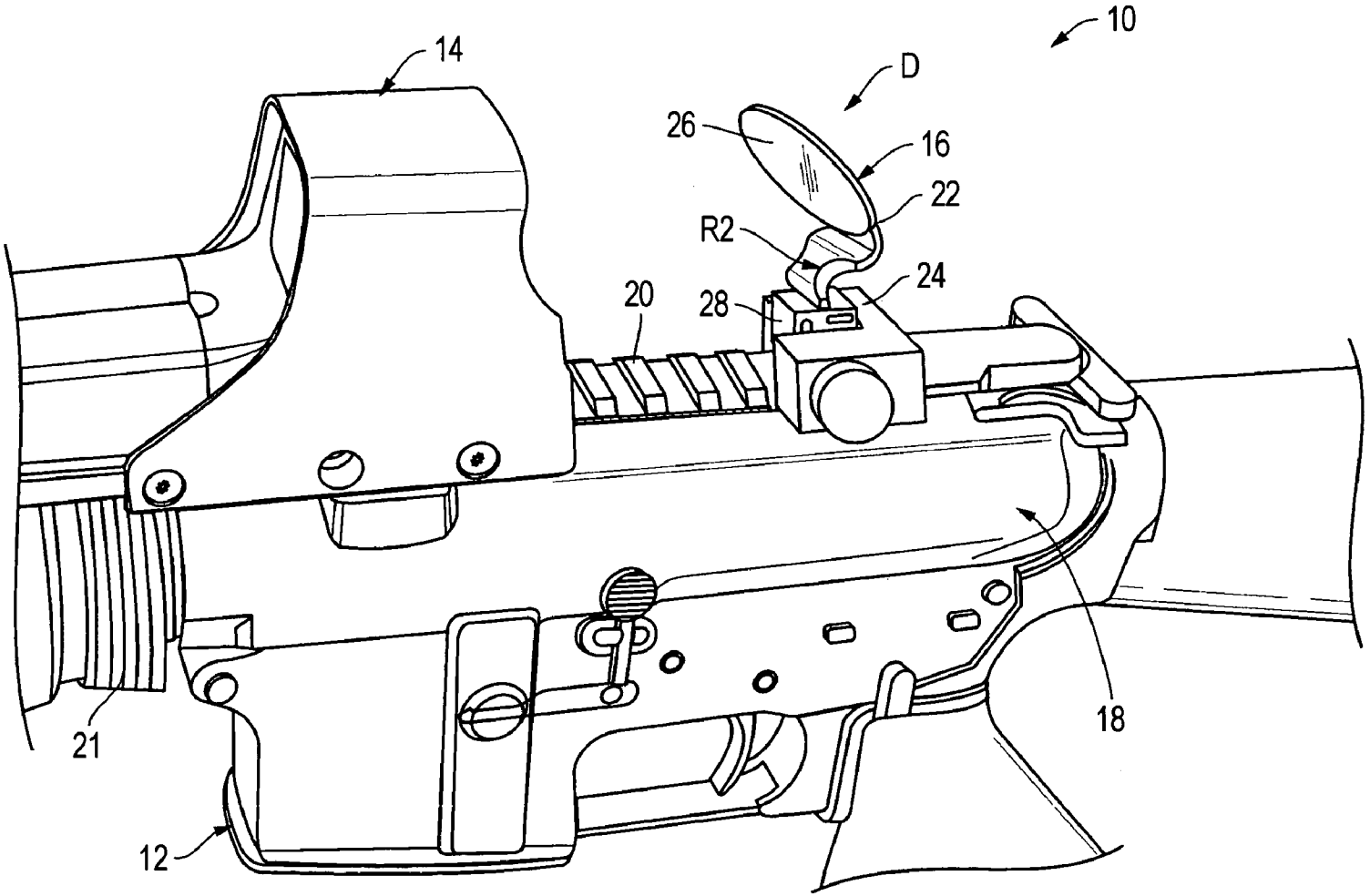
FIG. 2 depicts the single-mirror target viewing apparatus in a deployed position.
Figure 3:
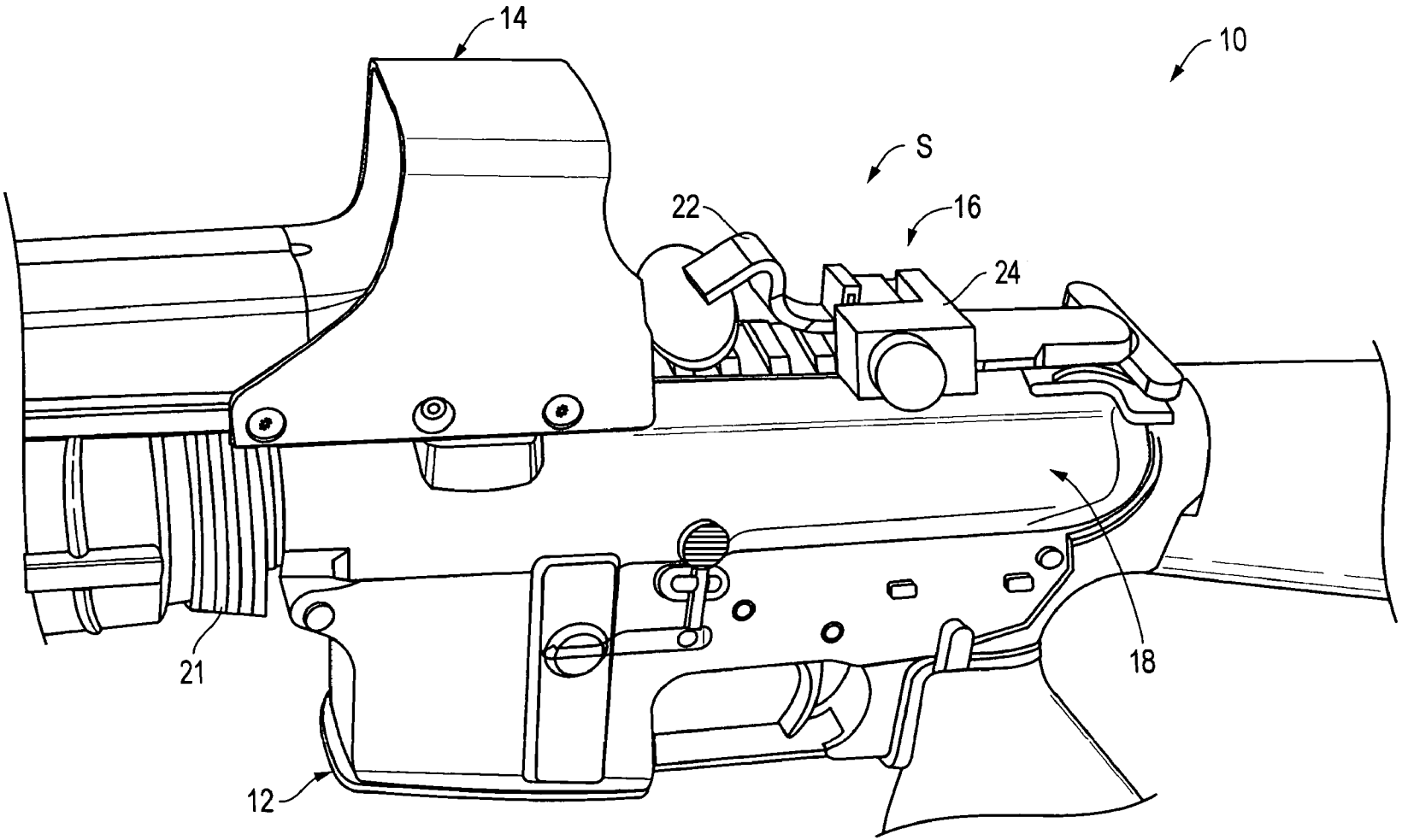
FIG. 3 depicts the single-mirror target viewing apparatus in a stowed position.

FIGS. 1–3 depict a first embodiment of a gun 10 adapted for enabling the gun 10 to be fired at a desired target from a cover position (e.g., around a corner of a wall, from over the top of an embankment, etc) in an aimed manner. The gun 10 includes a gun body 12, a target acquisition apparatus 14 and a single-mirror target viewing apparatus 16. The gun body 12 includes a receiver 18 and a mounting rail 20 (e.g., weaver rail or picatinny rail) attached the receiver 18. The single-mirror target viewing apparatus 16 depicted in FIGS. 1–3 is an embodiment of a single-mirror target viewing apparatus in accordance with an embodiment of the inventive disclosures made herein. The target acquisition apparatus 14 and a single-mirror target viewing apparatus 16 depicted in FIGS. 1–3 jointly represent a gun sight system in accordance with an embodiment of the inventive disclosures made herein.

The target acquisition apparatus 14 and the single-mirror target viewing apparatus 16 are attached to the mounting rail 20 of the gun body 12. As depicted, the target acquisition apparatus 14 and the single-mirror target viewing apparatus 16 are discrete apparatuses mounted directly on the mounting rail 20 of the gun body 12. It is contemplated herein that, in other embodiments, (not shown), the target acquisition apparatus 14 and the single-mirror target viewing apparatus 16 may be discrete apparatuses indirectly attached to the mounting rail 20 through a separate mounting device (e.g., precision-formed interposer rail) or may be an adjoined assembly (e.g., mounted on a common support structure) that is attached directly or indirectly to the mounting rail 20.

Alternately, the target acquisition apparatus 14 and/or the single-mirror target viewing apparatus 16 may be mounted on or integrated with components of the gun body 12 other than the mounting rail 20. For example, the single mirror target viewing apparatus 16 may be an integral component of the rear iron sights on a long-barrel gun (e.g., rifle or shot gun) or may be mounted on a carry handle of a long-barrel gun (e.g., a carrying handle of a M-16 style rifle).

As depicted in FIGS. 1–3, the target acquisition apparatus 14 and the single-mirror target viewing apparatus 16 are mounted above a barrel portion 21 of the gun 10. It is contemplated herein that the target acquisition apparatus 14 and the single-mirror target viewing apparatus 16 may be mounted below the barrel portion 21 of the gun 10 or to a side of the barrel portion 21 of the gun 10. The specific mounted location will depend on factors such as shooter preference, intended application, gun configuration (e.g., hand gun, rifle, shotgun, etc) and gun design (e.g., integral mounting devices).

The target acquisition apparatus 14 includes means for visually indicating when the gun 10 is aimed at a desired target. Examples of the target acquisition apparatus 14 include optical sight apparatuses, opto-electical sight apparatuses, and conventional mechanical sight apparatuses. An optical scope is an example of an optical sight apparatus. Trijicon brand, Docter Optic brand and EOTech brand target acquisition apparatuses are examples of opto-electical sight apparatuses that utilize laser, holographic, LED reflection and/or optical technologies. Examples of conventional mechanical sights include mechanical sights provided on the gun 10 by its original equipment manufacturer and accessory mechanical sights configured for being attached to the gun 10 after its manufacture. On a long-barrel gun (e.g., a rifle or shotgun), if an accessory front sight is required, attaching such accessory front sight on one side or both of a front tower sight construction (e.g., on an M-16 style rifle) is one preferred position. Alternatively, such an accessory front sight could be affixed to the barrel, to a barrel-insulating device or to an accessory rail that is attached to the barrel portion 21 or the receiver 18.

The single-mirror target viewing apparatus 16 includes a mirror assembly 22 and a mounting base 24. The mirror assembly 22 is movably attached to the mounting base 24. The mirror assembly 22 includes a single utilized mirror 26 (i.e., one or more redundant mirrors are contemplated) that defines a target imaging surface (e.g., reflective surface of the single utilized mirror). In at least embodiment, the single utilized mirror 26 is preferably essentially flat. In other embodiments, the mirror is non-planar. The mounting base 24 is attached to the mounting rail 18 of the gun body 12.

The mirror assembly 22 is moveably attached to the mounting base 24 in a manner enabling the mirror assembly 22 to be pivoted and rotated with respect to the mounting base 24. In this manner, the single utilized mirror 26 is movable between a stowed position S (FIG. 3) and a deployed position D (FIG. 2) and is movable between a plurality of rotational positions. For example, the single utilized mirror 26 is movable to a first rotated position R1 (FIG. 1) for achieving a use position U and to a second rotate position. R2 (FIG. 2) for enabling the mirror assembly 22 to be positioned in the stowed position S. Preferably, an axis of rotation of the mirror assembly 22 and/or the single utilized mirror 26 with respect to the mounting base 24 extends through a central region of the single utilized mirror 26. As disclosed above, the single utilized mirror 26 defines a target imaging surface, which as shown in FIGS. 1 and 2 is within the central region of the single utilized mirror 26. Thus, in at least one embodiment of the present invention, the axis of rotation of the single utilized mirror 26 extends through the target imaging surface of the single utilized mirror 26 when the single utilized mirror 26 is in a use position U. In this manner, the target imaging surface of the single utilized mirror 26 is skewed with respect to the axis of rotation of the single utilized mirror 26 when the single utilized mirror 26 is in the use position U such that the axis of rotation of the single utilized mirror 26 extends through the target imaging surface of the single utilized mirror 26 at a single point when the single utilized mirror 26 is in the use position U. Preferably, but not necessarily, the target imaging surface of the single utilized mirror 26 is skewed with respect to the axis of rotation of the single utilized mirror 26 throughout an entire range of rotation of the single utilized mirror 26 when the single utilized mirror 26 is in the deployed position D. It should be understood that the first rotated position R1 depicted in FIG. 1 is one example of a rotated position corresponding to a use position of the mirror assembly 22.

It is contemplated herein that, in an alternate embodiment (not shown) the mirror assembly 22 is positioned adjacent to one of the sides of the gun body 12 when in the stowed position S. Preferably, when in such a stowed position S, the single utilized mirror 26 faces the gun body 12 so as to protect the single utilized mirror 26 from damage. Optionally, a protective stowage enclosure (not shown) may be provided in which the single mirror is positioned when in the stowed position S.

Preferably, the mirror assembly 22 is selectively securable in the stowed position S and the deployed position D. In one embodiment, the mirror assembly 22 and the mounting base 24 are jointly configured for selectively securing the mirror assembly 22 in the stowed position S and the deployed position D. The mirror assembly 22 and the mounting base 24 including mating features (e.g., a biased positioning means and a detent) is one example of the mirror assembly 22 and the mounting base 24 being jointly configured for selectively securing the mirror assembly 22 in the stowed position S and the deployed position D.

Preferably, the mirror assembly 22 is selectively securable in one or more rotational positions (e.g., R1, R2, etc). To this end, the mirror assembly 22 includes a base attachment portion 28 to which the single utilized mirror 26 is rotatably attached and to which the mounting base 24 is pivotally attached. In such embodiment, the base attachment portion 28 and the single utilized mirror 26 are jointly configured for selectively securing the single utilized mirror 26 in one or more rotational positions with respect to the mounting base 24. The single utilized mirror 26 and the base attachment portion 28 including mating features (e.g., a biased positioning means and a detent) is one example of the mirror assembly 22 being configured for enabling the single utilized mirror 26 to be selectively secured in one or more rotational positions.

When in the use position U, the target imaging surface of the single utilized mirror 26 is in a skewed orientation with respect to a longitudinal axis of the barrel portion 21 of the gun 10. In this orientation, a desired target and means for visually indicating when the target is acquired in an aimed manner may be viewed on the target imaging surface with the gun held in a partially rotated position (i.e., rotated along its longitudinal axis to a position between about the 12 o'clock position and about the 3 o'clock or 9 o'clock positions). Accordingly, the single-mirror target viewing apparatus 16 enables a shooter to view on the target imaging surface both the desired target and the means for visually indicating when the gun is aimed at a desired target, thereby enabling the gun to be accurately fired from a cover position in an aimed manner.

Figure 4:
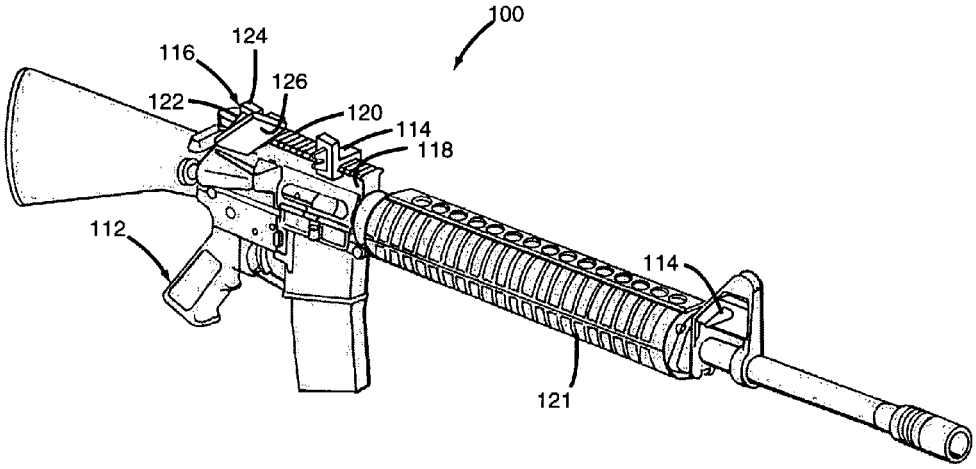
FIG. 4 depicts a gun adapted in accordance with a second embodiment of the inventive disclosures made herein, wherein a single-mirror target viewing apparatus of the gun has fixed orientation.

FIG. 4 depicts a second embodiment of a gun 100 adapted for enabling the gun 100 to be fired at a desired target from a cover position (e.g., around a corner of a wall, from over the top of an embankment, etc) in an aimed manner. The gun 100 includes a gun body 112, a target acquisition apparatus 114 (i.e., front and rear physical sights) and a single-mirror target viewing apparatus 116 that is fixedly attached (i.e., non-rotating and non-pivoting) to the gun body 112. The gun body 112 includes a receiver 118 and a mounting rail 120 attached the receiver 118. The single-mirror target viewing apparatus 116 depicted in FIG. 4 is an embodiment of a single-mirror target viewing apparatus in accordance with an embodiment of the inventive disclosures made herein. The target acquisition apparatus 114 and a single-mirror target viewing apparatus 116 depicted n FIG. 4 jointly represent a gun sight system in accordance with an embodiment of the inventive disclosures made herein.

The target acquisition apparatus 114 and the single-mirror target viewing apparatus 116 are attached to the mounting rail 120 of the gun body 112. As depicted, the target acquisition apparatus 114 and the single-mirror target viewing apparatus 116 are discrete apparatuses mounted directly on the mounting rail 120 of the gun body 112. It is contemplated herein that, in other embodiments, (not shown), the target acquisition apparatus 114 and the single-mirror target viewing apparatus 116 may be discrete apparatuses indirectly attached to the mounting rail 120 through a separate mounting device (e.g., precision-formed interposer rail) or may be an adjoined assembly (e.g., mounted on a common support structure) that is attached directly or indirectly to the mounting rail 120.

As depicted in FIG. 4, the target acquisition apparatus 114 and the single-mirror target viewing apparatus 116 are positioned to a right side of the gun body 112. It is contemplated herein that, in other embodiments (not shown), the target acquisition apparatus 114 and the single-mirror target viewing apparatus 116 may be positioned to a left side of the gun body 112 or a second single-mirror target viewing apparatus 116 may be mounted opposite the first single-mirror target viewing apparatus 116 (i.e., opposite the single-mirror target viewing apparatus 116 depicted in FIG. 4). The specific mounted location and number of target viewing apparatuses will depend on factors such as shooter preference, intended application, gun configuration (e.g., hand gun, rifle, etc) and gun design (e.g., integral mounting devices).

The target acquisition apparatus 114 includes means for visually indicating when the gun 100 is aimed at a desired target. Examples of the target acquisition apparatus 114 include optical sight apparatuses, opto-electical sight apparatuses, and conventional mechanical sight apparatuses. An optical scope is an example of an optical sight apparatus. Trijicon brand, Docter Optic brand and EOTech brand target acquisition apparatuses are examples of opto-electical sight apparatuses that utilize laser, holographic, LED reflection and/or optical technologies. Examples of conventional mechanical sights include mechanical sights provided on the gun 100 by its original equipment manufacturer and accessory mechanical sights configured for being attached to the gun 10 after its manufacture. On a long-barrel gun (e.g., a rifle or shotgun), if an accessory front sight is required, attaching such accessory front sight on one side or both of a front tower sight construction (e.g., on an M-16 style rifle) is one preferred position. Alternatively, such an accessory front sight could be affixed to the barrel, to a barrel-insulating device or to an accessory rail that is attached to the barrel portion 121 or the receiver 118.

The single-mirror target viewing apparatus 116 includes a mirror assembly 122 and a mounting base 124. The mirror assembly 122 is fixedly (i.e., non-rotating and non-pivoting) to the mounting base 124 and includes a single utilized mirror 126 that define a target imaging surface (e.g., reflective surface of the single utilized mirror). Preferably, the single utilized mirror 126 is essentially flat. The mounting base 124 is attached to the mounting rail 120 of the gun body 112.

When in the use position U, the target imaging surface of the single utilized mirror 126 is in a skewed orientation with respect to a longitudinal axis of the barrel portion 121 of the gun 100. In this orientation, a desired target and means for indicating when the target is acquired in an aimed manner may be viewed on the target imaging surface with the gun held in a partially rotated position (i.e., rotated along its longitudinal axis to a position between about the 12 o'clock position and about the 3 o'clock or 9 o'clock positions). Accordingly, single-mirror target viewing apparatus 116 enables a shooter to view on the target imaging surface both the desired target and the means for visually indicating when the gun is aimed at a desired target, thereby enabling the gun to be to accurately fired from a cover position in an aimed manner.

Figure 5:
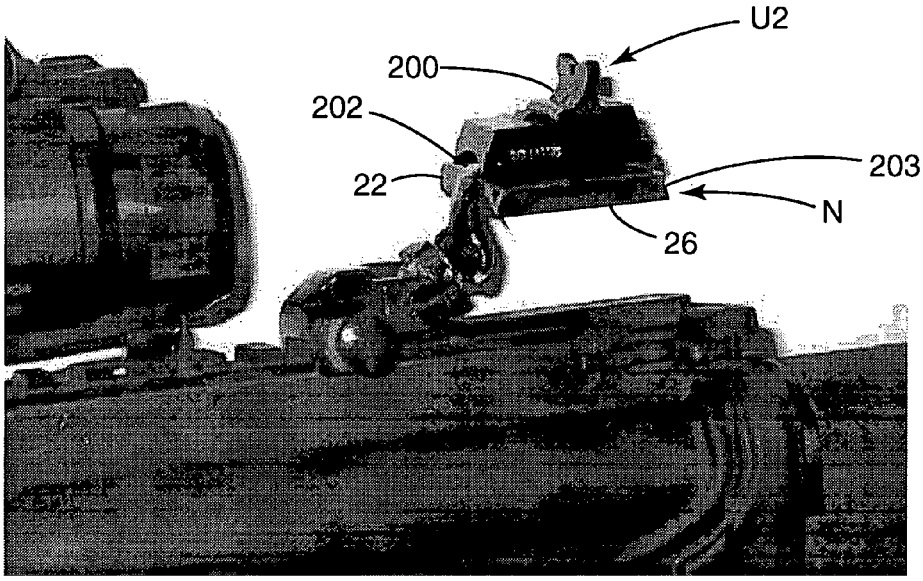
FIG. 5 depicts an embodiment of a sighting device attached to the mirror apparatus of the single-mirror target viewing apparatus depicted in FIG. 1.

FIG. 5 depicts the single-mirror target viewing apparatus 16 of FIGS. 1–3 having a mechanical sight 200 attached to the mirror assembly 22. It is disclosed herein that the mechanical sight 200 may be a discrete component attached to the mirror assembly 22 or may be an integrally attached component of the mirror assembly 22 to which the single utilized mirror 26 is attached. The mechanical sight 200 is one example of a sighting device. Implementation of other types of sighting devices (e.g., optical, electro-optical and other mechanical sighting devices) is contemplated and disclosed herein.

The mechanical sight 200 is attached to a non-viewing portion of the single utilized mirror 26, thereby moving in concert with the mirror assembly 22. Examples of non-viewing portions of the single utilized mirror include, but are not limited to, the back surface 202 (e.g., a mirror encasement major surface) and edges 203 of the single utilized mirror (e.g., an edge surface of the mirror encasement). It is disclosed herein that the mechanical sight 200 may be fixedly or removably attached to the mirror assembly 22. The mirror assembly 22 is in a non-use position N (i.e., not in its respective use position U depicted in FIG. 2) when the mechanical sight 200 is in a respective use position U2. Accordingly, the mechanical sight 200 may be used for targeting when in its respective use position U2 and the mirror assembly 22 may be used for targeting when in its respective use position U.

Guns configured with target viewing apparatuses in accordance with the inventive disclosures made herein are used in conjunction with a target acquisition apparatus to facilitate accurately shooting from a cover position (e.g., around a corner) with minimal or no exposure of the shooter's body. Such target viewing apparatuses are positioned generally in line with and behind an associated target acquisition apparatus. Such target viewing apparatuses include a single utilized mirror that may be adjustable to allow for tilting the gun at different horizontal angles (i.e. laid over on its side relative to the shooter). It is preferable for the mirror to be positioned so as to require the shooter to lay the gun at a minimum of approximately 45 degrees from vertical in order to use a wall or other obstacle to protect as much of the shooter's hand as possible. For left-handed shooting (i.e., the right side of the gun exposed to the shooter) on guns with a right side ejection port, it is preferred that the mirror be positioned so as to require that the gun be laid over to a degree where cartridges will not be ejected into the shooter's face.

Use of target viewing apparatuses in accordance with the inventive disclosures made herein in conjunction with handguns to facilitate accurately shooting from a cover position is contemplated. Generally, the underlying configuration discussed above in reference to long barrel guns also applies to handguns. In one embodiment specific to handguns, the target viewing apparatus and an opto-electrical target acquisition apparatus are mounted beneath the barrel of the handgun. Accordingly, the shooter can accurately aim and shoot around a corner by utilizing the mirror to acquire the target and to aim. Preferably, adjustability of the mirror is restricted so as to require the shooter to orient the gun in a non-vertical orientation. The non-vertical position serves the purpose of helping to protect the shooter's hand behind cover and also protect the shooter's face from shells that are being ejected out of the gun.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice embodiments of the inventive disclosures made herein. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A targeting apparatus for a gun, comprising:

a mirror assembly including a single utilized mirror that provides a target imaging surface;

a mounting base configured for being attached to a gun and having the mirror assembly moveably attached thereto, wherein the single utilized mirror is rotatable between a plurality of rotational positions and wherein the single utilized mirror is movable between a use position and a non-use position; and a mechanical gunsight attached to the mirror assembly;

wherein an axis of rotation of the single utilized mirror extends through the targeting surface of the single utilized mirror when the single utilized mirror is in a use position; and wherein the target imaging surface of the single utilized mirror is skewed with respect to the axis of rotation of the single utilized mirror when the single utilized mirror is in the use position such that the axis of rotation of the single utilized mirror extends through the target imaging surface of the single utilized mirror at a single point when the single utilized mirror is in the use position.

2. The targeting apparatus of claim 1 wherein the mechanical gunsight moves in concert with the single utilized mirror and wherein the mirror assembly is selectively securable in a non-use position such that the mechanical gunsight is secured in the use position when the mirror assembly is secured in the non-use position.

3. The targeting apparatus of claim 1 wherein the mirror assembly is pivotally mounted on the mounting base for enabling the mirror assembly to be moved between a stowed position and a deployed position.

4. The targeting apparatus of claim 1 wherein at least one of the mirror assembly and the mounting base are configured for selectively securing the mirror assembly in at least one of said rotational positions.

5. The targeting apparatus of claim 1 wherein:

the mirror assembly is pivotally mounted on the mounting base for enabling the mirror assembly to be moved between a stowed position and a deployed position; and the mirror assembly and the mounting base are jointly configured for selectively securing the mirror assembly in at least one of said rotational positions.

6. A gun sight system, comprising:

a target acquisition apparatus mountable on a gun and including means for visually indicating when the gun is aimed at a desired target;

a single-mirror target viewing apparatus mountable on the gun and including a single utilized mirror that provides a target imaging surface, wherein the single-mirror target viewing apparatus is configured for enabling a shooter to view on the target imaging surface both the desired target and said means for visually indicating thereby enabling the gun to be fired at the desired target from a cover position in an aimed manner; wherein the single utilized mirror is rotatable between a plurality of rotational positions and wherein the single utilized mirror is movable between a use position and a non-use position; and a mechanical gunsight attached to the single-mirror viewing apparatus in a manner whereby the mechanical gunsight is in a respective use position when the mirror assembly is in the non-use position;

wherein an axis of rotation of the single utilized mirror extends through the targeting surface of the single Utilized mirror when the single utilized mirror is in a use position; and wherein the target imaging surface of the single utilized mirror is skewed with respect to the axis of rotation of the single utilized mirror when the single utilized mirror is in the use position such that the axis of rotation of the single utilized mirror extends through the target imaging surface of the single utilized mirror at a single point when the single utilized mirror is in the use position.

7. The gun sight system of claim 6 wherein:

the single-mirror target viewing apparatus includes a mirror assembly and a mounting base having the mirror assembly movably attached thereto, the mirror assembly includes the single utilized mirror;

the mounting base is configured for being attached to the gun, and the mirror assembly is moveably attached to the mounting base in a manner enabling the single utilized mirror to be movable between a stowed position and a deployed position.

8. The gun sight system of claim 7 wherein the mirror assembly is pivotally mounted on the mounting base for enabling the mirror assembly to be moved between the stowed position and the deployed position.

9. The gun sight system of claim 7 wherein the mirror assembly and the mounting base are jointly configured for, selectively securing the mirror assembly in at least one of said rotational positions.

10. The gun sight system of claim 7 wherein the mechanical gunsight moves in concert with the single utilized mirror and wherein the mirror assembly is selectively securable in the non-use position such that the mechanical gunsight is secured in the use position when the mirror assembly is secured in the non-use position.

11. A gun configured for being fired at a desired target from a cover position in an aimed manner, comprising:

a gun body;

a target acquisition apparatus mounted on the gun body and includes means for visually indicating when the gun is aimed at a desired target;

a single-mirror target viewing apparatus mounted on the gun body and including a single utilized mirror that provides a target imaging surface, wherein the single-mirror target viewing apparatus is configured for enabling a shooter to view on the target imaging surface both the desired target and the means for visually indicating thereby enabling the gun to be fired at the desired target from a cover position in an aimed manner; wherein the single utilized mirror is rotatable between a plurality of rotational positions and wherein the single utilized mirror is movable between a use position and a non-use position; and a mechanical gunsight attached to the single-mirror viewing apparatus in a manner whereby the mechanical gunsight is in a respective use position when the mirror assembly is in the non-use position;

wherein an axis of rotation of the single utilized mirror extends through the targeting surface of the single utilized mirror when the single utilized mirror is in a use position; and wherein the target imaging surface of the single utilized mirror is skewed with respect to the axis of rotation of the single utilized mirror when the single utilized mirror is in the use position such that the axis of rotation of the single utilized mirror extends through the target imaging surface of the single utilized mirror at a single point when the single utilized mirror is in the use position.

12. The gun of claim 11 wherein:

the single-mirror target viewing apparatus includes a mirror assembly and a mounting base having the mirror assembly movably attached thereto, the mirror assembly includes the single utilized mirror;

the mounting base is configured for being attached to the gun, and the mirror assembly is moveably attached to the mounting base in a manner enabling the single utilized mirror to be movable between a stowed position and a deployed position.

13. The gun of claim 12 wherein the mirror assembly is pivotally mounted on the mounting base for enabling the mirror assembly to be moved between the stowed position and the deployed position.

14. The gun of claim 12 wherein the mirror assembly and the mounting base are jointly configured for selectively securing the mirror assembly in at least one of said rotational positions.

15. The gun of claim 12 wherein the mechanical gunsight moves in concert with the single utilized mirror and wherein the mirror assembly is selectively securable in the non-use position such that the mechanical gunsight is secured in the use position when the mirror assembly is secured in the non-use position.

* * * * *